US005088385A

United States Patent [19]

McKee

[11] Patent Number: 5,088,385

[45] Date of Patent: Feb. 18, 1992

[54] ACTUATOR APPARATUS WITH SECONDARY SEAL MOTION

[75] Inventor: Bobby D. McKee, San Jose, Calif.

[73] Assignee: Westinghouse Electric Corp., Pittsburgh, Pa.

[21] Appl. No.: 656,531

[22] Filed: Feb. 19, 1991

[51] Int. Cl.[5] ..... F01B 31/00

[52] U.S. Cl. ..... 92/130 R; 92/135; 92/DIG.4; 277/2; 277/27; 277/176; 277/205; 277/193

[58] Field of Search ..... 92/130 R, 135, 163, 92/DIG. 4; 277/2, 3, 27, 173, 176, 177, 193, 205

[56] References Cited

U.S. PATENT DOCUMENTS

| | | | |
|---|---|---|---|
| 1,973,323 | 9/1934 | Adams | 277/2 |
| 2,783,744 | 3/1957 | Tennis | 92/163 X |
| 2,928,685 | 3/1960 | Tracy | 277/3 |
| 3,730,057 | 5/1973 | Friden | 92/163 X |
| 3,894,741 | 7/1975 | McHugh | 277/27 |
| 3,914,752 | 10/1975 | Howard et al. | 277/2 X |
| 4,106,779 | 8/1978 | Zabcik | 277/177 X |
| 4,655,159 | 4/1987 | McMills | 277/2 X |
| 4,901,629 | 2/1990 | Mohn | 277/3 X |

*Primary Examiner*—Edward K. Look
*Assistant Examiner*—Todd Mattingly
*Attorney, Agent, or Firm*—D. Schron

[57] ABSTRACT

An actuator having a plurality of concentric cylinders with the inner and outer cylinders being adapted to connect to apparatus which must move relative to one another. Flexible sealing rings are positioned between adjacent cylinders and when the pressure within the cylinders is increased, the flexibility sealing rings will be forced against the action of a spring. When the pressure is relieved, the flexible sealing rings will return to their original position. In another mode of operation, if the pressure is further increased, instead of being relieved, normal operation of the actuator will take place.

4 Claims, 5 Drawing Sheets

ACTUATOR APPARATUS WITH SECONDARY SEAL MOTION

The U.S. Government has rights in this invention pursuant to a contract with the Department of the Air Force.

BACKGROUND OF THE INVENTION

1. Field of the Invention

The invention in general relates to a telescoping actuator mechanism, and particularly to an improved sealing arrangement therefore.

2. Background Information

Actuators are a common mechanism utilized to produce axial motion in response to pressure from a working fluid. Many actuators take the form of concentric cylinders isolated to the ambient pressure by means of flexible seals. When the pressure of the fluid introduced into the volume between the cylinders exceeds a certain value, the telescopic arrangement of concentric cylinders will extend and thereafter retract when the pressure is relieved.

In those applications where the actuators are frequently cycled, the flexible seals are exercised thereby increasing their useful life. However, in those applications where the actuators are cycled infrequently, the seals tend to loose performance characteristics which can lead to premature degradation or failure of the sealing function.

In the present invention an improved sealing arrangement is provided whereby the seals of the actuator may be exercised without the requirement for extending or retracting the cylinders.

SUMMARY OF THE INVENTION

Actuator apparatus is provided which includes a plurality of concentric cylinders movable relative to one another along a longitudinal axis. A flexible sealing ring is provided for each adjacent pair of cylinders and is positioned between, and in sliding contact with, both adjacent cylinders and is coaxial with the longitudinal axis. A spring means is positioned between each adjacent pair of cylinders and in addition, a coaxial longitudinally movable motion ring is positioned on one side of the sealing ring and movable against the spring means. Means are provided for supplying and removing a pressurized fluid to the volume between the cylinders and the apparatus is operable in a first mode of operation such that when the fluid pressure is of a relatively low value, it will cause longitudinal movement of the flexible sealing ring and motion ring against the spring means. When the pressure is relieved, the spring means will force the flexible sealing ring and the motion ring to return to their original position, thus exercising the sealing ring without extending the cylinders. In a second mode of operation, the supplied fluid pressure is of a relatively higher value so as to cause said relative movement of the concentric cylinders to an extended position.

DESCRIPTION OF THE PREFERRED EMBODIMENTS

Figure 1:
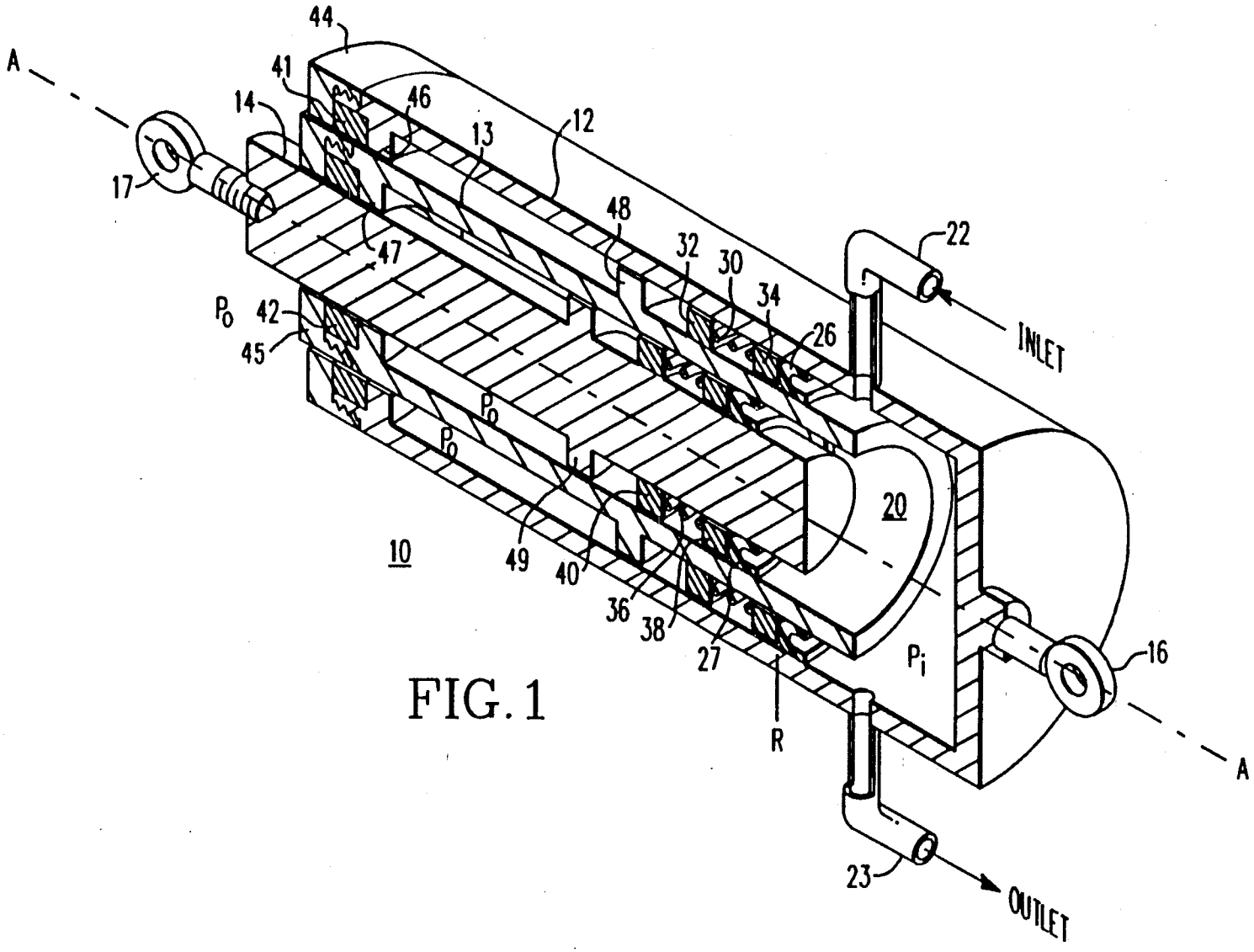
FIG. 1 is a cross-sectional view of an actuator mechanism in accordance with one embodiment of the present invention.

Referring now to FIG. 1, there is illustrated an actuator 10 having a plurality of concentric cylinders movable relative to one another along a longitudinal axis AA. By way of example, three cylinders are illustrated with two of the cylinders 12 and 13 being hollow and the third cylinder 14 being solid. The cylinders 12 and 14 include respective attachment means 16 and 17 for connection to structures which are to move relative to one another. In operation, a pressurized fluid may be introduced into the volume 20 between the cylinders by means of an inlet connection 22 and the pressurized fluid may be withdrawn by means of the same connection 22 or by means of an alternate outlet 23.

In order to maintain pressure integrity between the pressurized volume and the ambient pressure, there is provided for each adjacent set of cylinders a respective flexible sealing ring such as sealing ring 26 between cylinders 12 and 13, and flexible sealing ring 27 between cylinders 13 and 14. The sealing rings 26 and 27, which are U-shaped in cross-section, are coaxial about the longitudinal axis AA and are in sliding engagement with adjacent cylinder walls.

A spring means 30 is interposed between cylinders 12 and 13 and has a one end which is limited in movement by means of a guide ring 32. Such guide ring, which may be of bronze and welded to cylinder 13, provides a bearing surface for lateral stability of the adjacent cylinders. The other end of spring means 30 contacts a motion ring 34 which is coaxial about axis AA and is operable to longitudinally move against the spring action, as is sealing ring 26. A similar arrangement including spring means 36 and motion ring 38 is positioned between cylinders 13 and 14 and extends between guide ring 40 and sealing ring 27. Spring means 30 or 36 may be constituted by a plurality of individual springs positioned around the circumference of the cylinders or alternatively each may be constituted by a single spring member which is coaxial about longitudinal axis AA.

For additional lateral stability guide rings 41 and 42 may be provided at the lower ends of the cylinders, between respective threadedly engaged end caps 44 and 45 and respective flanges 46 and 47.

In a first mode of operation, a working fluid is introduced into the volume 20 by way of inlet connection 22 and is of a pressure $P_i$ where $P_i$ is greater than ambient pressure $P_o$ but of a value insufficient to relatively move the actuator cylinders 12 to 14.

Figure 2:
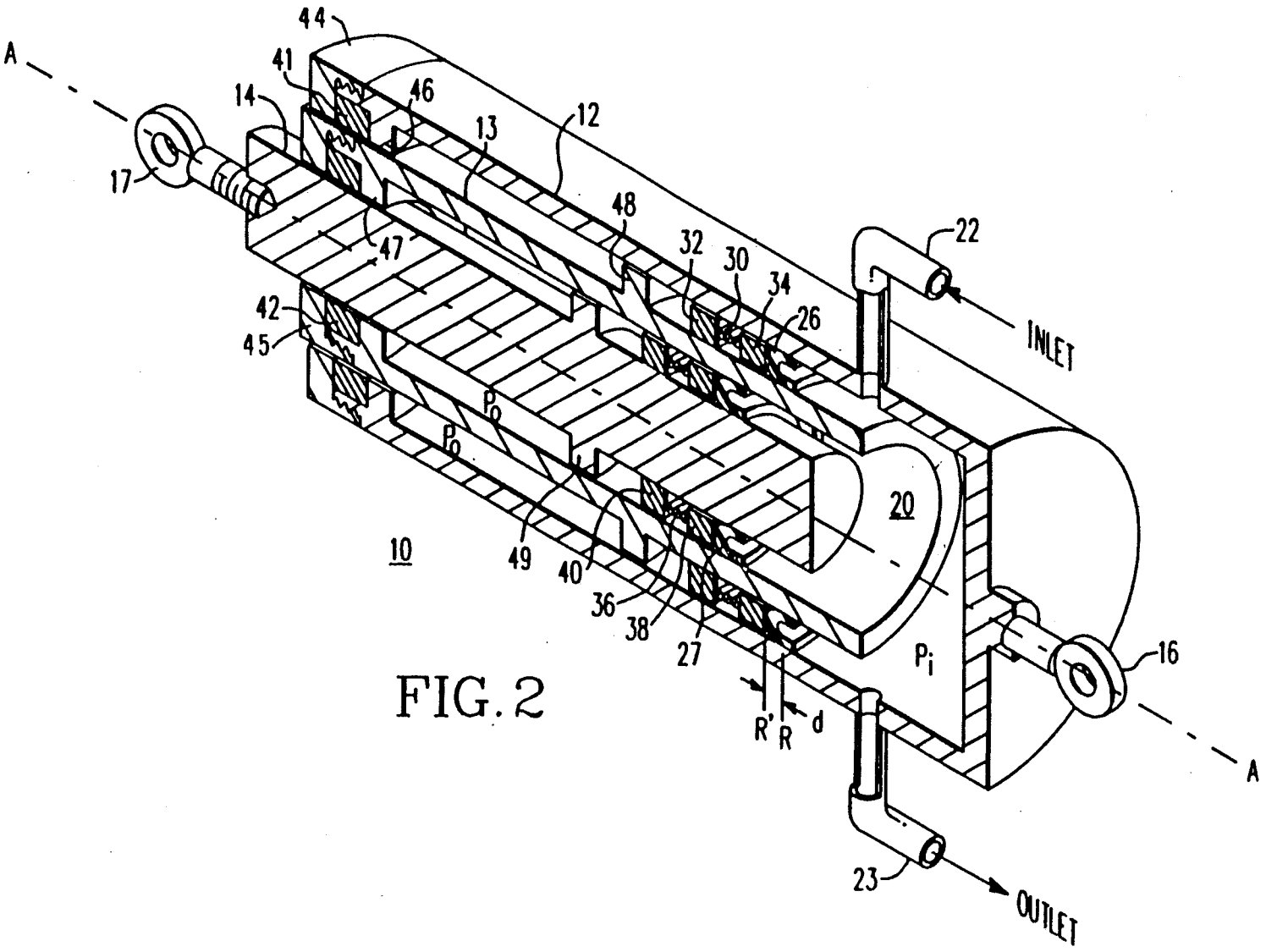
FIG. 2 illustrates the actuator of FIG. 1 in a first mode of operation, wherein the seals are exercised.

The pressure is of sufficient value, however, to move the seals 26 and 27 against the action of springs 30 and 36 to thereby exercise the seals. By way of example, the letter R in FIG. 1 illustrates a reference position for seal 26. After the introduction of the working fluid, and as illustrated in FIG. 2, sealing ring 26 will have moved a distance d to a new reference position R'. This same operation and movement will also be experienced by the other sealing ring 27. When the working fluid within volume 20 is removed by way of connection 22 or 23, the sealing rings will be forced, by their respective spring means, back to their original position as illustrated in FIG. 1.

Figure 3:
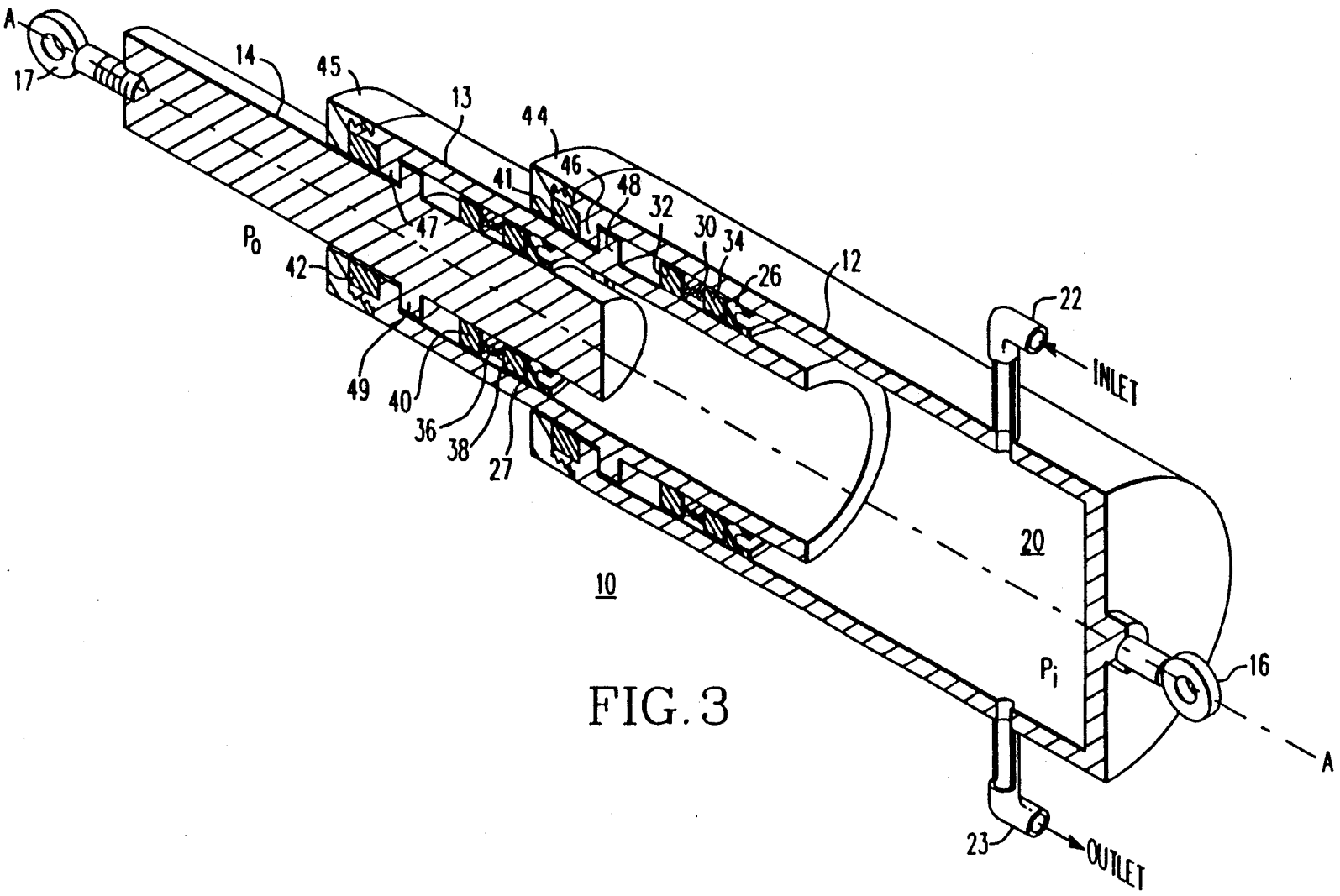
FIG. 3 illustrates the actuator in a second mode of operation in which the cylinders of the actuator are extended.

In a second mode of operation, and as illustrated in FIG. 3, the pressure $P_i$ of the working fluid is increased to a value relative to $P_o$ so as to cause relative movement of the cylinders 12 to 14 thereby effecting relative movement of the components to which attachments 16 and 17 are connected. As illustrated in FIG. 3, it is seen that flanges 46 and 47 contact respective flanges 48 and 49 and serve as stops to limit relative movement of the cylinders.

Figure 4:
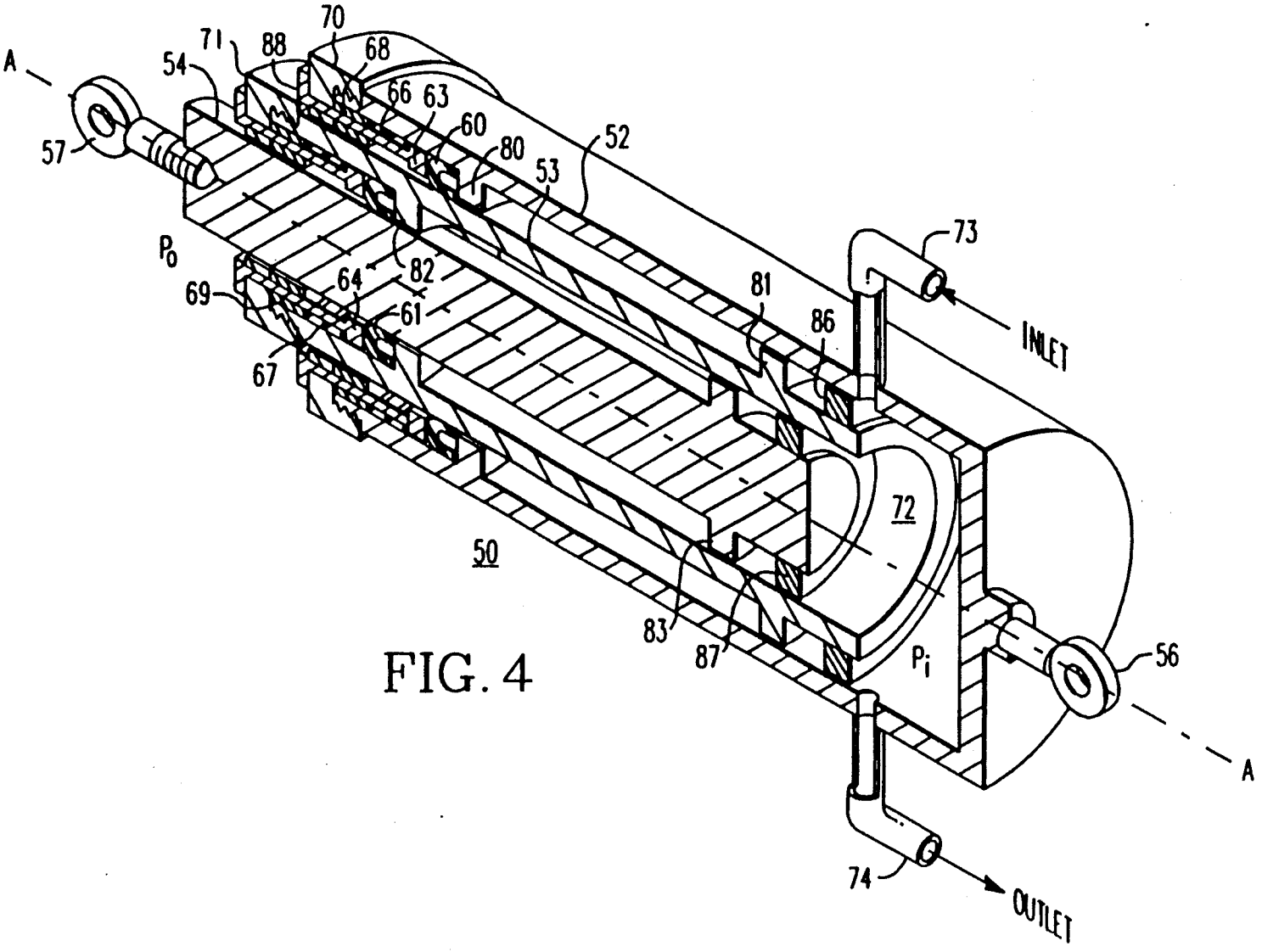
FIG. 4 is a cross-sectional view of another embodiment of the present invention.
Figure 6:
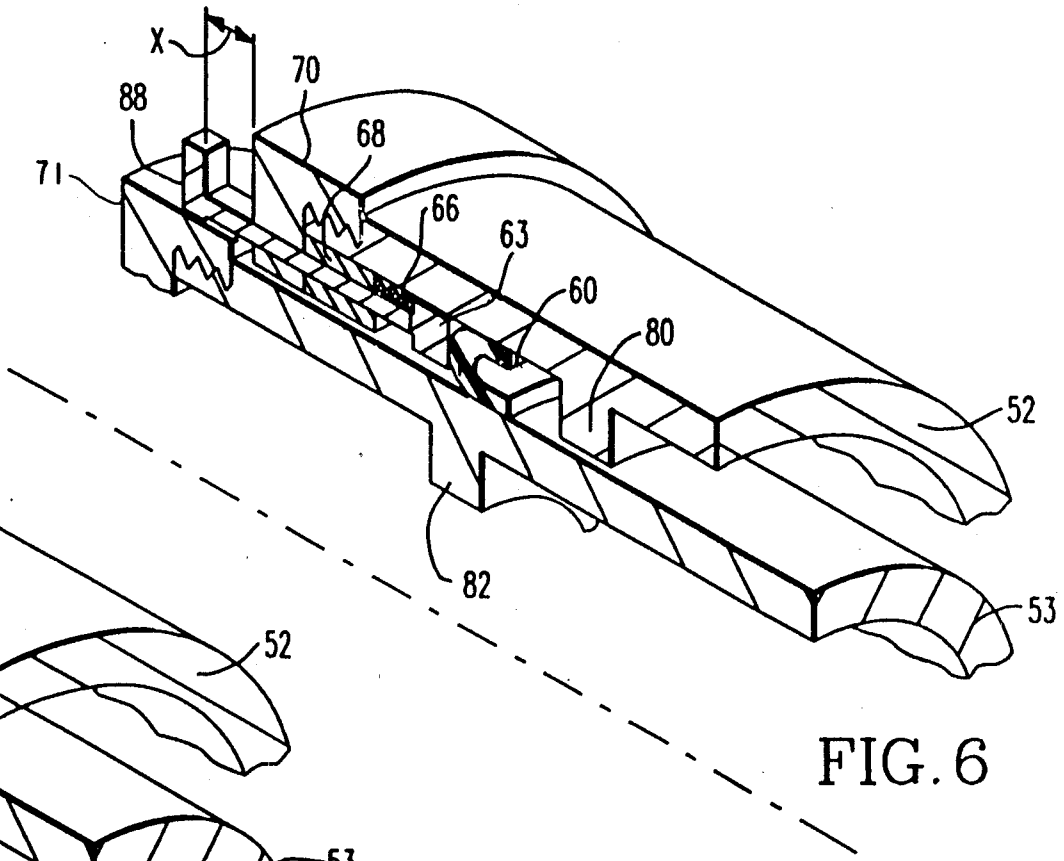
FIGS. 5 and 6 are respected views of a retracted and extended indicator device for the actuator of FIG. 4.

In FIG. 4, illustrating another embodiment of the invention, actuator 50 includes a plurality of cylinders 52 to 54 arranged for relative movement along longitudinal axis AA. Attachment means 56 and 57 are connected to respective cylinders 52 and 54 to effect relative movement of the devices to which they are connected.

Flexible sealing rings 60 and 61, similar to those already described with respect to FIG. 1, are respectively interposed between cylinders 52 and 53, and 53 and 54. The flexible sealing rings 60 and 61 rest on respective motion rings 63 and 64 with the arrangement operable to move against the action of respective spring means 66 and 67. Lateral stability guide rings 68 and 69 abut end caps 70 and 71 and serve as stops for limiting movement of the sealing ring—motion ring—spring means combination.

When a working fluid is introduced into the volume 72 by means of inlet connection 73, the pressure $P_i$ is of such magnitude, in a first mode of operation so as to cause movement of the sealing rings 60 and 61 against the spring action. If the pressure is then relieved by removing the working fluid through connection 73 or 74, the sealing rings will return to their original position.

The actuator function is accomplished in a second mode of operation by increasing the pressure $P_i$ to a point where the cylinders 52 to 54 are caused to move relative to one another with movement of cylinder 53 being limited with respect to cylinder 52 by means of contacting of flanges 80 and 81. In a similar fashion, movement of cylinder 54 is limited relative to cylinder 53 by the contact of flanges 82 and 83. Guide rings 86 and 87 may be welded to respective cylinders 53 and 54, as illustrated, to provide for additional lateral stability.

Figure 5:
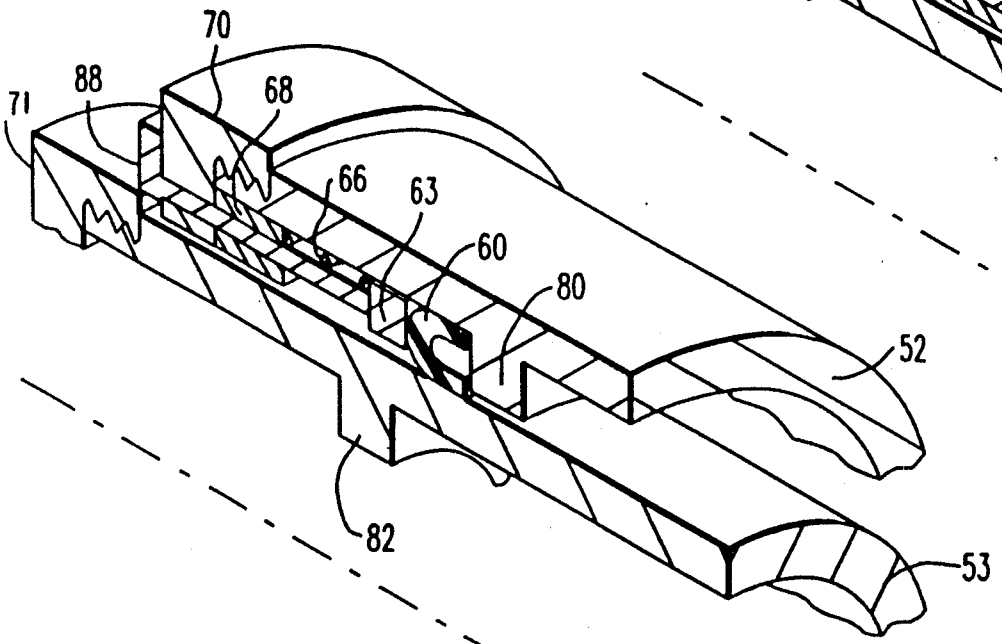

Under some circumstances, it may be desirable to be provided with an indication of movement of the flexible sealing rings. In this regard, FIG. 5 illustrates a portion of the cylinders 52 and 53, of FIG. 4, along with the sealing ring 60 and motion ring 63. An indicator or flag 88 is connected to the motion ring 63 through apertures in guide ring 68 and end cap 70 and when the internal pressure is increased, the motion of the sealing ring 60 will cause the indicator 88 to project beyond the end cap 70 by a distance X thereby providing a visual indication of sealing ring movement. A similar arrangement may also be provided for the other flexible sealing ring 61.

Accordingly, there has been described actuator apparatus which is capable of exercising its flexible seals without the requirement for extending or retracting its cylinders. This arrangement enables the actuator to lubricate the seating surface for the seals and minimize any set that the seals may be taking. Further, depending upon the seal material, this exercising function will prevent any vulcanization between the seal ring and its contacting surface.

What is claimed is:

1. Actuator apparatus, comprising:

a) a plurality of concentric cylinders moveable relative to one another along a longitudinal axis;

b) a flexible sealing ring for each adjacent pair of said cylinders and positioned between, and in sliding contact with both said adjacent cylinders and being coaxial with said longitudinal axis;

c) spring means positioned between each adjacent pair of said cylinders;

d) a coaxial, longitudinally moveable motion ring for each adjacent pair of said cylinders and positioned on one side of said sealing ring between said adjacent cylinders and moveable against said spring means;

e) means for limiting movement of said spring means;

f) means for supplying and removing a pressurized fluid to the volume between said cylinders;

g) the pressure of said fluid being of a relatively low value, in a first mode of operation, to cause longitudinal movement of said flexible sealing ring and said motion ring against said spring means whereby when said pressure is relieved, said flexible sealing ring and said motion ring will return to their original position;

h) the pressure of said fluid being of a relatively higher value, in a second mode of operation, to cause said relative movement of said cylinders.

2. Apparatus according to claim 1 wherein:

a) said means for limiting movement of each said spring means is a flange surrounding a respective said cylinder.

3. Apparatus according to claim 1 wherein:

a) said means for limiting movement of each said spring means is an end cap threadedly engaged on the end of a respective cylinder and through which a subsequent cylinder projects.

4. Apparatus according to claim 3 which includes:

a) a visual indicator which projects through said end cap;

b) said visual indicator being in a normally retracted position and being responsive to movement of said flexible sealing ring to move to an extended position during said first and second modes of operation.

* * * * *